US010294774B2

(12) United States Patent
Aklestad et al.

(10) Patent No.: US 10,294,774 B2
(45) Date of Patent: May 21, 2019

(54) WELL TRAJECTORY PLANNING USING BOUNDING BOX SCAN FOR ANTI-COLLISION ANALYSIS

(71) Applicant: Schlumberger Technology Corporation, Sugar Land, TX (US)

(72) Inventors: Darren Lee Aklestad, Katy, TX (US); Chun Wang, Beijing (CN); Lu Jiang, Beijing (CN); Nannan Zhang, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 441 days.

(21) Appl. No.: 14/892,264

(22) PCT Filed: Jun. 12, 2014

(86) PCT No.: PCT/US2014/042102

§ 371 (c)(1),
(2) Date: Nov. 19, 2015

(87) PCT Pub. No.: WO2014/201237

PCT Pub. Date: Dec. 18, 2014

(65) Prior Publication Data

US 2016/0102544 A1 Apr. 14, 2016

Related U.S. Application Data

(60) Provisional application No. 61/834,042, filed on Jun. 12, 2013.

(51) Int. Cl.

| | |
|---|---|
| ***E21B 47/024*** | (2006.01) |
| ***E21B 7/04*** | (2006.01) |
| ***E21B 43/30*** | (2006.01) |

(52) U.S. Cl.
CPC ..... *E21B 47/024* (2013.01); *E21B 7/04* (2013.01); *E21B 43/305* (2013.01)

(58) Field of Classification Search
CPC ..... E21B 47/022; E21B 7/04; E21B 44/00; E21B 47/024; E21B 47/09; E21B 7/10
See application file for complete search history.

(56) References Cited

U.S. PATENT DOCUMENTS 5,901,795 A 5/1999 Tsao et al.
6,078,867 A 6/2000 Plumb et al.
(Continued)

FOREIGN PATENT DOCUMENTS

CA 2975437 A1 * 9/2016 ..... E21B 43/00
GB 2458356 A 9/2009
(Continued)

OTHER PUBLICATIONS

International Search Report and the Written Opinion for International Application No. PCT/U52014/042102 dated Oct. 15, 2014.
(Continued)

*Primary Examiner* — Daniel P Stephenson

(57) ABSTRACT

A method for evaluating a planned well trajectory for avoidance of collision with an existing wellbore includes constructing a bounding box about the planned well trajectory and a bounding box for a trajectory of at least one existing wellbore. If there is no intersection between the bounding boxes, the planned well trajectory is used for drilling a well.

21 Claims, 5 Drawing Sheets

(56) References Cited

U.S. PATENT DOCUMENTS

| | | | | |
|---|---|---|---|---|
| 6,411,903 | B2 | 6/2002 | Bush | |
| 7,003,439 | B2 | 2/2006 | Aldred et al. | |
| 7,059,427 | B2 | 6/2006 | Power et al. | |
| 7,260,508 | B2 | 8/2007 | Lim et al. | |
| 7,878,268 | B2 | 2/2011 | Chapman et al. | |
| 8,462,012 | B2 | 6/2013 | Clark et al. | |
| 9,127,530 | B2 | 9/2015 | Lowdon et al. | |
| 9,322,950 | B2 * | 4/2016 | Gustavsson | E21B 47/0002 |
| 9,745,842 | B2 | 8/2017 | Jain | |
| 2004/0015795 | A1 | 1/2004 | Frank et al. | |
| 2007/0088530 | A1 | 4/2007 | Erignac et al. | |
| 2008/0289877 | A1 | 11/2008 | Nikolais-Mouchas et al. | |
| 2009/0152005 | A1 | 6/2009 | Chapman et al. | |
| 2009/0164125 | A1 * | 6/2009 | Bordakov | E21B 47/04 702/6 |
| 2010/0084191 | A1 | 4/2010 | Chapman et al. | |
| 2010/0169018 | A1 | 7/2010 | Brooks | |
| 2010/0185427 | A1 | 7/2010 | Tilke et al. | |
| 2011/0157235 | A1 * | 6/2011 | FitzSimmons | G01V 99/00 345/672 |
| 2011/0172976 | A1 | 7/2011 | Budiman et al. | |
| 2012/0273205 | A1 | 11/2012 | Metcalfe et al. | |
| 2013/0000898 | A1 | 1/2013 | Boone | |
| 2013/0043025 | A1 | 2/2013 | Scott | |
| 2013/0140037 | A1 | 6/2013 | Sequeira, Jr. et al. | |
| 2013/0140088 | A1 | 6/2013 | Williams | |
| 2013/0146285 | A1 | 6/2013 | Chhina et al. | |
| 2013/0191081 | A1 | 7/2013 | Jain et al. | |
| 2014/0214387 | A1 * | 7/2014 | Tilke | E21B 43/305 703/10 |
| 2014/0348385 | A1 * | 11/2014 | Kozicz | G06K 9/00369 382/103 |
| 2015/0331971 | A1 * | 11/2015 | Scollard | E21B 43/30 703/1 |
| 2016/0090822 | A1 * | 3/2016 | Lu | E21B 41/0092 703/1 |
| 2016/0102530 | A1 * | 4/2016 | Baranov | E21B 43/00 703/10 |
| 2016/0102544 | A1 * | 4/2016 | Aklestad | E21B 43/305 175/45 |
| 2016/0108719 | A1 * | 4/2016 | Danisch | G01C 9/00 175/57 |
| 2017/0138175 | A1 * | 5/2017 | Shi | E21B 7/04 |
| 2017/0160424 | A1 * | 6/2017 | Omeragic | G01V 3/28 |
| 2017/0328192 | A1 * | 11/2017 | Wessling | E21B 44/00 |
| 2018/0003007 | A1 * | 1/2018 | Wang | E21B 41/0092 |

FOREIGN PATENT DOCUMENTS

| | | | |
|---|---|---|---|
| WO | 2009014838 | A1 | 1/2009 |
| WO | 2010053618 | A1 | 5/2010 |
| WO | 2011015824 | A2 | 2/2011 |
| WO | 2013105969 | A1 | 7/2013 |
| WO | 2014201237 | A1 | 12/2014 |

OTHER PUBLICATIONS

Baranova "Cyclical Elliptical Pedal Surfaces," Journal of Mathematics and System Science, vol. 1, 2011, David Publishing, pp. 1-6.

Williamson "Accuracy Prediction for Directional Measurement While Drilling," SPE 67616, SPE Drill. & Completion, vol. 15, No. 4, Society of Petroleum Engineers, Dec. 2000, pp. 221-233.

Williamson "Accuracy Prediction for Directional MWD," SPE 56702, Society of Petroleum Engineers, prepared for presentation at the 1999 SPE Annual Technical Conference and Exhibition held in Houston, Texas, Oct. 3-6, 1999, pp. 1-16.

"International Search Report and Written Opinion issued in International Patent application PCT/US2014/068145 dated Mar. 25, 2015. 14 Pages".

* cited by examiner

WELL TRAJECTORY PLANNING USING BOUNDING BOX SCAN FOR ANTI-COLLISION ANALYSIS

CROSS-REFERENCE TO RELATED APPLICATIONS

This application claims priority as a Patent Cooperation Treaty patent application of U.S. Provisional Patent Application Ser. No. 61/834,042 filed Jun. 12, 2013 with the same title.

BACKGROUND

This disclosure relates generally to the field of wellbore trajectory planning for multiple wells proximate each other drilled through subsurface formations. More specifically, the disclosure relates to techniques for more efficiently identifying well trajectories which do not present material risk of collision with other proximate wellbores.

Subsurface formations in a particular geographic area may have a one or more reservoirs containing economically useful materials such as oil and gas. In order to economically extract such materials wellbores may be drilled from selected positions on the Earth's surface or the bottom of a body of water such as a lake or ocean. Such wellbores may be drilled along preselected trajectories in order to reduce and/or minimize distances between surface or water bottom locations of the wellbores while intersecting one or more reservoirs or portions thereof by wellbores. Drilling along such preselected trajectories is known in the art as directional drilling. Directional drilling uses certain types of drilling tools, for example steerable drilling motors or rotary steerable directional drilling systems to cause a drill bit to drill the well along the preselected trajectory. It is also known in the art to measure the position of each well along its trajectory at selected positions in order to determine how closely the well is following the predetermined trajectory.

The measurements of position have inherent error because of limitations in the accuracy of the sensors used to make the measurements. Thus, the absolute position of any wellbore at any position along its trajectory is subject to a degree of uncertainty. A description of a standard technique for calculating positional uncertainty at any point along a particular wellbore is described in H. S. Williamson, *Accuracy Prediction for Directional Measurement While Drilling*, paper no. 67616, 15 (4), Society of Petroleum Engineers, Richardson, Tex. (December 2000). The positional uncertainty calculation according to methods such as described in the foregoing publication is computationally expensive and may be time consuming, including, in particular, the computation of separation distances between wells in detail over entire well trajectories.

SUMMARY

A method according to one aspect for evaluating a planned well trajectory for avoidance of collision with an existing wellbore includes constructing a bounding box about the planned well trajectory and a bounding box for a trajectory of at least one existing wellbore. If there is no intersection between the bounding boxes, the planned well trajectory is used to drill a well.

Other aspects and advantages will be apparent from the description and claims that follow,

DETAILED DESCRIPTION

Figure 1:
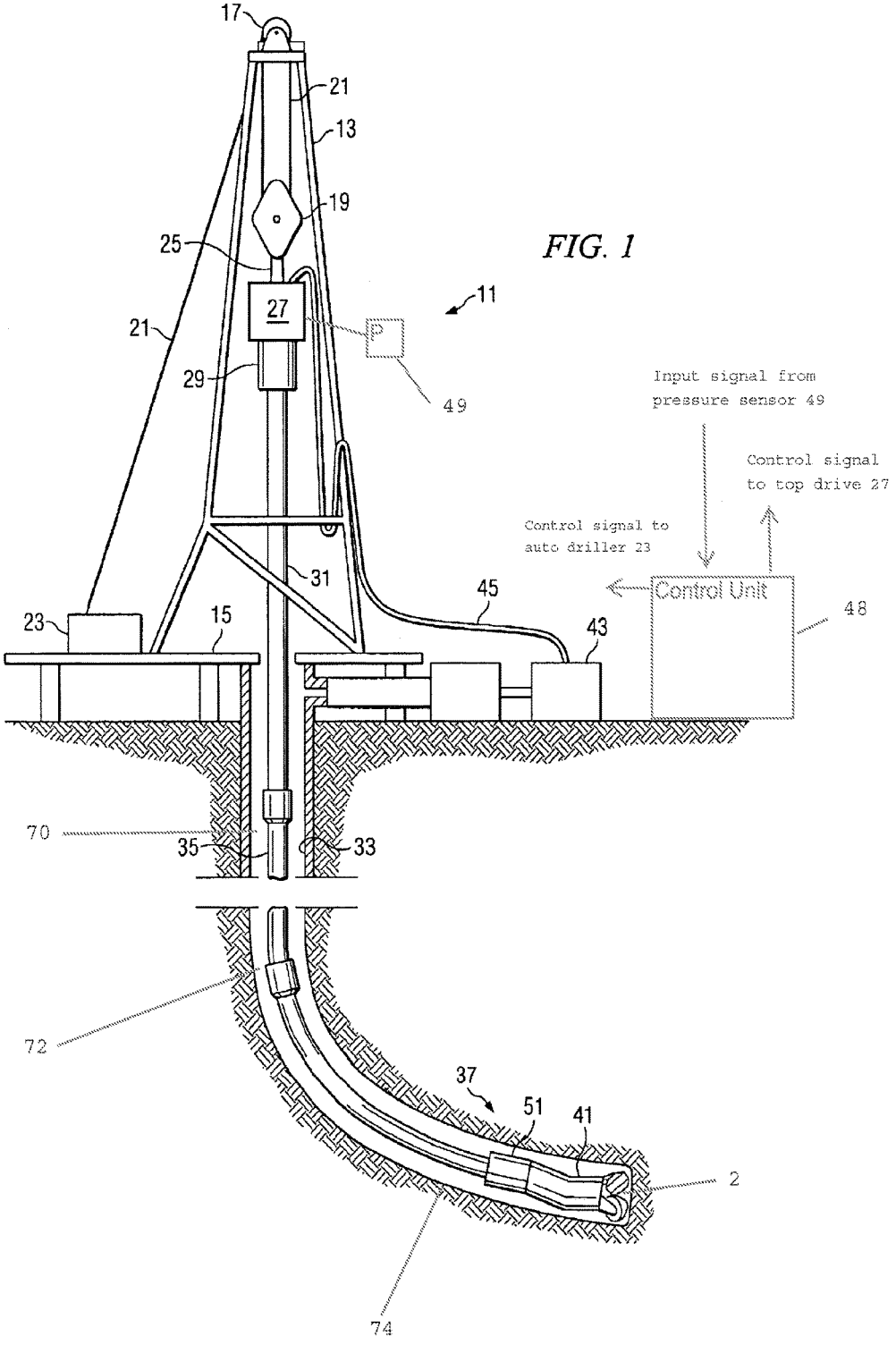
FIG. 1 is a pictorial view of a wellbore drilling system.

In FIG. 1, a drilling unit or "drilling rig" is designated generally at 11. The drilling rig 11 in FIG. 1 is shown as a land-based drilling rig. However, as will be apparent to those skilled in the art, the examples described herein will find equal application on marine drilling rigs, such as jack-up rigs, semisubmersibles, drill ships, and the like.

The drilling rig 11 includes a derrick 13 that is supported on the ground above a rig floor 15. The drilling rig 11 includes lifting gear, which includes a crown block 17 mounted to derrick 13 and a traveling block 19. The crown block 17 and the traveling block 19 are interconnected by a cable 21 that is driven by draw works 23 to control the upward and downward movement of the traveling block 19. The draw works 23 may be configured to be automatically operated to control rate of drop or release of the drill string into the wellbore during drilling. One non-limiting example of an automated draw works release control system is described in U.S. Pat. No. 7,059,427 issued to Power et al. and incorporated herein by reference.

The traveling block 19 carries a hook 25 from which is suspended a top drive 27. The top drive 27 supports a drill string, designated generally by the numeral 31, in a wellbore 33. According to an example implementation, the drill string 31 may be in signal communication with and mechanically coupled to the top drive 27 through an instrumented sub 29. As will be described in more detail, the instrumented top sub 29 may include sensors (not shown separately) that provide drill string torque information. Other types of torque sensors may be used in other examples, or proxy measurements for torque applied to the drill string 31 by the top drive 27 may be used, non-limiting examples of which may include electric current (or related measurement corresponding to power or energy) or hydraulic fluid flow drawn by a motor (not shown) in the top drive. A longitudinal end of the drill string 31 includes a drill bit 2 mounted thereon to drill the formations to extend (drill) the wellbore 33.

The top drive 27 can be operated to rotate the drill string 31 in either direction, as will be further explained. A load sensor 26 may be coupled to the hook 25 in order to measure the weight load on the hook 25. Such weight load may be related to the weight of the drill string 31, friction between the drill string 31 and the wellbore 33 wall and an amount of the weight of the drill string 31 that is applied to the drill bit 2 to drill the formations to extend the wellbore 33.

The drill string 31 may include a plurality of interconnected sections of drill pipe 35 a bottom hole assembly (BHA) 37, which may include stabilizers, drill collars, and a suite of measurement while drilling (MWD) and or logging while drilling (LWD) instruments, shown generally at 51.

A steerable drilling motor 41 may be connected proximate the bottom of BHA 37. It will be appreciated by those skilled in the art that other directional drilling systems known in the art, a non-limiting example of which is a rotary steerable directional drilling system may be used in other directional drilling implementations. The steerable drilling motor 41 may be any type known in the art for rotating the drill bit 2 and/or selected portions of the drill string 31 and to enable change in trajectory of the wellbore during slide drilling or to perform rotary drilling. Example types of drilling motors include, without limitation, positive displacement fluid operated motors, turbine fluid operated motors, electric motors and hydraulic fluid operated motors. The present example motor 41 may be operated by drilling fluid flow. Drilling fluid may be delivered to the drill string 31 by mud pumps 43 through a mud hose 45. In some examples, pressure of the drilling mud may be measured by a pressure sensor 49. During drilling, the drill string 31 is rotated within the wellbore 33 by the top drive 27, in a manner to be explained further below. As is known in the art, the top drive 27 is slidingly mounted on parallel vertically extending rails (not shown) to resist rotation as torque is applied to the drill string 31. During drilling, the bit 2 may be rotated by the motor 41, which in the present example may be operated by the flow of drilling fluid supplied by the mud pumps 43. Although a top drive rig is illustrated, those skilled in the art will recognize that the present example may also be used in connection with systems in which a rotary table and kelly are used to apply torque to the drill string 31. Drill cuttings produced as the bit 2 drills into the subsurface formations to extend the wellbore 33 are carried out of the wellbore 33 by the drilling mud as it passes through nozzles, jets or courses (none shown) in the drill bit 2.

Signals from the pressure sensor 49, the hookload sensor 26, the instrumented top sub 29 and from an MWD/LWD system or steering tool 51 (which may be communicated using any known wellbore to surface communication system, such as mud pulse telemetry to provide just one example), may be received in a control unit 48, which will be further explained with reference to FIG. 2. Signals from the MWD/LWD system 51 may be used to perform surveys of the well at selected positions along its trajectory both during drilling and thereafter during "washing", "reaming" or drill string movement procedures.

Figure 2:
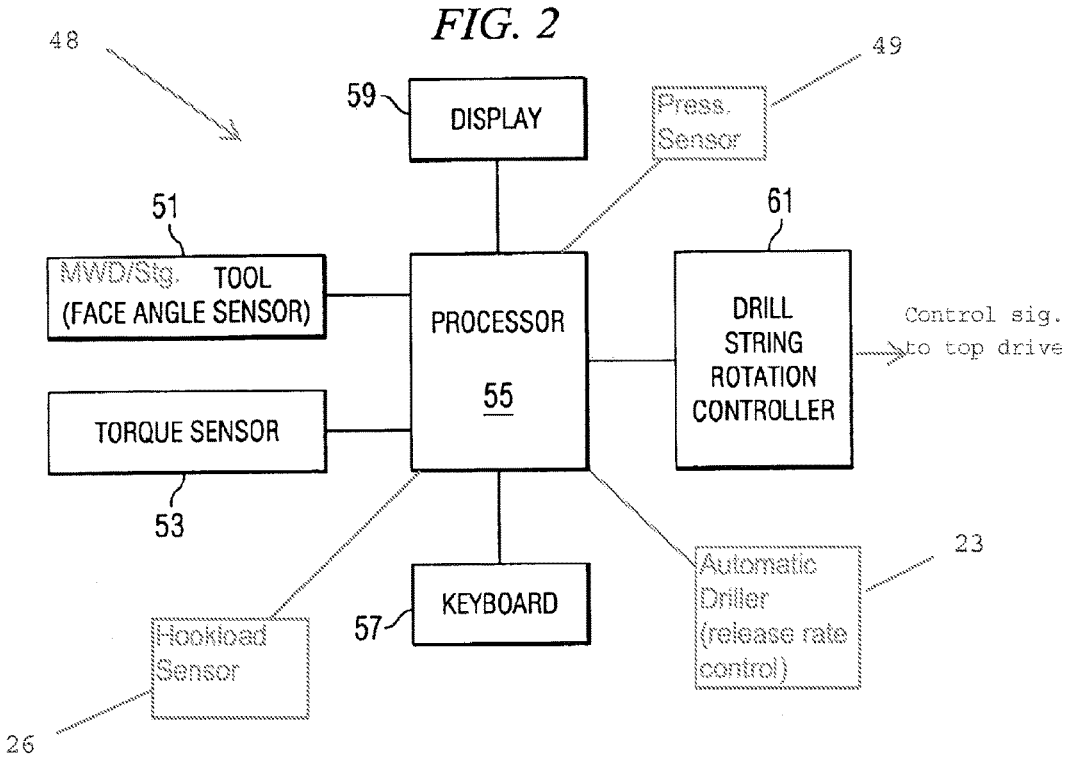
FIG. 2 is a block diagram of an example pipe rotation control system.

FIG. 2 shows a block diagram of the functional components of a non-limiting example of the control unit 48. The control unit 48 may include a drill string rotation control system. Such system may include a torque related parameter sensor 53. The torque related parameter sensor 53 may provide a measure of the torque (or related measurement as explained above) applied to the drill string (31 in FIG. 1) at the surface by the top drive or kelly. The torque related parameter sensor 53 may be implemented, for example, as a strain gage in the instrumented top sub (29 in FIG. 1) if it is configured to measure torque. The torque related parameter sensor 53, as explained above may also be implemented, for example and without limitation, as a current measurement device for an electric rotary table or top drive motor, as a pressure sensor for an hydraulically operated top drive, or as an angle of rotation sensor for measuring drill string rotation. In principle, the torque related parameter sensor 53 may be any sensor that measures a parameter that can be directly or indirectly related to the amount of torque applied to the drill string.

The output of the torque related parameter sensor 53 may be received as input to a processor 55. In some examples, output of the pressure sensor 49 and/or one or more sensors of the MWD/LWD system or steering tool 51 may also be provided as input to the processor 55. A particular input from the MWD/LWD system or steering tool 51 may be the orientation angle with respect to geomagnetic or geodetic direction and Earth's gravity of a bend in the housing of the steerable drilling motor (41 in FIG. 1). The foregoing may be referred to as "toolface angle", or "toolface." Toolface angle may be measured with reference to geomagnetic or geodetic direction when the wellbore is inclined from vertical below a selected threshold inclination angle, as a non-limiting example five degrees. Above the threshold wellbore inclination angle, the toolface may be measured with reference to the uppermost surface of the wellbore, known as "high side" toolface.

The processor 55 may be any programmable general purpose processor such as a programmable logic controller (PLC) or may be one or more general purpose programmable computers or may include one or more application-specific processors (e.g., ASICs). The processor 55 may receive user input from user input devices, such as a keyboard 57. Other user input devices such as touch screens, keypads, and the like may also be used. The processor 55 may also provide visual output to a display 59. The processor 55 may also provide output to a drill string rotation controller 61 that operates the top drive (27 in FIG. 1) or rotary table (FIG. 3) to rotate the drill string as will be further explained below.

The drill string rotation controller 61 may be implemented, for example, as a servo panel (not shown separately) that attaches to a manual control panel for the top drive. One such servo panel is provided with a service sold under the service mark SLIDER, which is a service mark of Schlumberger Technology Corporation, Sugar Land, Tex. The drill string rotation controller 61 may also be implemented as direct control to the top drive motor power input (e.g., as electric current controls or variable orifice hydraulic valves). The top drive control can also be implemented as computer coded instructions in the control unit 48 that, when executed by a processor (e.g., processor 55), enables operation of the top drive controller 27. The type of drill string rotation controller is not a limit on the scope of the present disclosure.

The processor 55 may also accept as input signals from the hookload sensor 26. The processor 55 may also provide output signals to the automated draw works 23 as explained with reference to FIG. 1.

Referring once again to FIG. 1, an example "directional" wellbore, that is, one that is drilled along a selected trajectory other than vertical, may be initially drilled as a vertical wellbore, shown at 70. During this part of the drilling operation, the draw works 23 are released to enable some of the weight of the drill string 35 to be transferred to the drill bit 2. During this part of the drilling operation, the drill string 35 may be rotated to maintain the trajectory of the wellbore substantially along a vertical path. Signals from the pressure sensor 49 may be conducted to the control unit 48 which in turn may operate the draw works 23 as explained with reference to FIG. 2 so that the measured pressure does not exceed a value associated with "stalling" of the steerable drilling motor 41.

Figure 3:
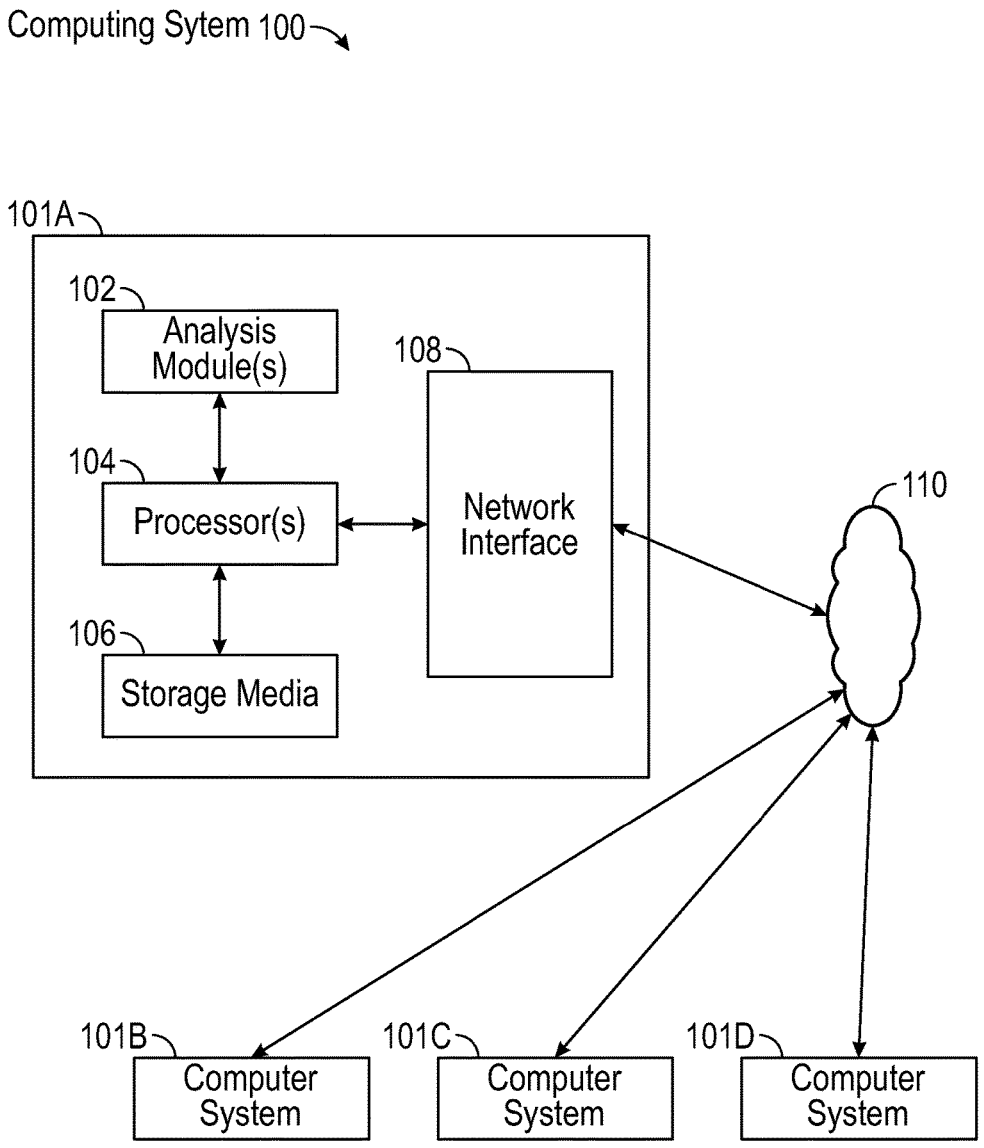
FIG. 3 shows an example computer system that may be used to implement example embodiments of an anti-collision technique according to the present disclosure.

Survey measurements made during directional drilling or at other times on any particular wellbore may be included in a database for processing according to example methods consistent with the present disclosure. An example computing system that may be used to perform such calculations is shown in FIG. 3. The computing system 100 may be an individual computer system 101A or an arrangement of distributed computer systems. The computer system 101A may include one or more analysis modules 102 that may be configured to perform various tasks according to some embodiments, such as the tasks described below. To perform these various tasks, analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be on a ship underway on the ocean or on a well drilling location, while in communication with one or more computer systems such as 101C and/or 101D that may be located in one or more data centers on shore, aboard ships, and/or located in varying countries on different continents).

A processor can include a microprocessor, microcontroller, processor module or subsystem, programmable integrated circuit, programmable gate array, application-specific integrated circuit, a system-on-a-chip (SoC) processor, or another suitable control or computing device.

The storage media 106 can be implemented as one or more computer-readable or machine-readable storage media. Note that while in the exemplary embodiment of FIG. 3 the storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 3, and/or computing system 100 may have a different configuration or arrangement of the components depicted in FIG. 3. The various components shown in FIG. 3 may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

An example method for determining whether a proposed well trajectory is within a prescribed safe distance from another well trajectory, or any other well trajectory where multiple wellbores may exist to produce fluids from various reservoirs within a field of geographically proximate reservoirs may be explained as follows.

First, the proposed trajectory may have an ellipse of uncertainty ("EOU") calculated for each of a plurality of selected positions along the planned well trajectory. Calculating the EOU may be performed, for example, as described in H. S. Williamson, *Accuracy Prediction for Directional Measurement While Drilling*, paper no. 67616, 15 (4), Society of Petroleum Engineers, Richardson, Tex. (December 2000), incorporated herein by reference. One output of the calculation technique described in the foregoing reference is an error covariance matrix of uncertainty. Such covariance matrix is defined in Eq. A-16 in the appendix thereof.

In the present example, a "bounding box" may be generated to encompass the proposed well trajectory and to encompass well trajectory survey data from: (i) proximate wellbores; (ii) all wells drilled from one or more wellbore "slots" (or common wellhead locations) in the case of bottom supported platform or bottom positioned well position templates; (iii) all wells drilled from individual structures, such as bottom supported platforms or water bottom templates; and (iv) all wells drilled in an entire "field" which may include one or more structures and/or reservoirs therein. The bounding boxes represent large volume and simple shape boxes used to test whether there is any overlap between such bounding boxes.

In the present example, AABB (axis-aligned bounding boxes) may be constructed subject to the constraint that the edges of the box are parallel to the coordinate axes. In other examples, different alignment bounding boxes may be used. However, it should be understood that before storage or intersection detection, the coordinates of all the bounding boxes should ideally be referenced to a common origin and coordinate system. Further, various coordinate systems may be used in connection with the disclosed techniques, such as geodetic, spherical, or grid coordinates, which can be obtained by standard coordinate transformation methods.

As an example, Cartesian coordinates may be used in one embodiment, wherein the three main axes are North (N) displacement from the surface position (or water bottom position) of the well, East (E) displacement from the surface or water bottom position and Vertical (V), i.e., true vertical depth of the wellbore. Six coordinates are needed to define a bounding box, note Nmax (upper boundary in the North direction), Nmin (lower boundary in the North direction), Emax, Emin, (maximum and minimum in the East direction) and Vmax, Vmin (maximum and minimum true vertical depth).

Wellbore collisions (intersection of a well being drilled with an existing well) may occur if the actual position of a wellbore differs from its presumed position based on survey data. The presumed position of the well consists of a well path centerline and an associated EOU which is derived from a selected error model. An error model that may be used is the ISCWSA (Industry Steering Committee on Wellbore Survey Accuracy) model which considers the error as an EOU. An EOU is an ellipsoid with equal probability on the surface. The size of EOU may be determined by a confidence multiplier.

Thus, to build a reliable bounding box, the EOU may be taken into consideration and a bounding box may be defined which encloses not only individual survey points but the EOU at each survey point inside. The confidence multiplier may then be selected. The confidence multiplier may be set by the policy of the operator of a given field or structure to correspond to an acceptable probability of collision; such probability may be associated with a Gaussian error distribution.

The bounding box for a planned well trajectory may be hierarchically compared to bounding boxes for nearby wells, associated template slots (if used), associated drilling structures and an associated field, such as a geologic field or a geographically proximate set of drilling structures. In the present example therefore, one may build a bounding box for a well, for nearby wells, for slots, for a structures, and for a field. Only when a higher-hierarchical bounding box has been detected to have intersection with the planned well's bounding box, the lower-hierarchical bounding box will be used to do a further collision scan. The hierarchy will be explained below with reference to FIG. 4.

The bounding box may be defined based on the EOU. As previously explained, the bounding box should enclose the entire EOU at any well path position. In some examples, to align the bounding box with an anti-collision standard (especially some standard with the definition of a separation factor), the pedal surface of the EOU will also be needed to be enclosed by the bounding box. The reason for defining a bounding box to enclose the pedal surface of the EOU is that in practice, the pedal curve method is frequently used for separation factor calculations. Various methods of calculating separation factor are known in the art. The separation factor may be defined as the ratio of the distance between a point on a subject well and a point on another well divided by the combined uncertainty of the positions in each well. Various methods known in the art can be considered in how to combine the uncertainties. Examples may include simple addition of the uncertainties, or as is the case for the pedal curve, the addition of the associated covariance matrices, then by multiplication of the resulting matrix with the vector between the positions yields a single uncertainty distance.

Basically, the EOU maximum radius calculated is not the radius of ellipsoid used, but the radius of the pedal surface of the EOU is used. By taking the foregoing into consideration, the bounding box may be defined to enclose all the pedal surface of ellipsoids inside. Calculating the pedal surface of an ellipsoid may be performed, for example, using a method described in, Eva Baranová, *Cyclical Elliptical Pedal Surfaces,* Journal of Mathematics and System Science 1 (2011) 1-6, David Publishing.

Considering the complexity of the form of an ellipsoid and that of the pedal curve, in the present example, it is possible to simply consider a more conservative volume which can enclose the EOU inside: a bounding sphere of EOU. In this case, only the major axis length in 3D for the EOU is needed.

In such case, $$\text{Major axis in } 3D = \text{Max(Eigenvalues of Covariance Matrix)} \quad (1)$$

The covariance matrix may be calculated as explained above. In the three above defined coordinate directions (N, E, V), this major axis length will be used for calculating extreme or maximum values for defining the bounding box. In an example implementation one may first calculate the extreme or maximum values at each survey position, whether along an existing well or along a planned well trajectory. In the following expressions, TempNmax stands for temporary Nmax, and correspondingly temporary maximum and minimum values may be defined for the remaining five positional variables: TempNmin, TempEmax, TempEmin, TempVmax, TempVmin.

$$\text{Temp}N\text{max} = N + 0.5 * \text{Hole diameter} + \max\{a, \text{Major axis in } 3D \text{ at this station}\} \quad (2)$$

$$\text{Temp}N\text{min} = N - 0.5 * \text{Hole diameter} - \max\{a, \text{Major axis in } 3D \text{ at this station}\} \quad (3)$$

$$\text{Temp}E\text{max} = E + 0.5 * \text{Hole diameter} + \max\{a, \text{Major axis in } 3D \text{ at this station}\} \quad (4)$$

$$\text{Temp}E\text{min} = E - 0.5 * \text{Hole diameter} - \max\{a, \text{Major axis in } 3D \text{ at this station}\} \quad (5)$$

$$\text{Temp}V\text{max} = V + \text{Major axis in } 3D \text{ at this station} \quad (6)$$

$$\text{Temp}V\text{min} = V - \text{Major axis in } 3D \text{ at this station} \quad (7)$$

wherein a represents a defined minimum extreme value in case the EOU radius is too small near the uppermost portion of the well.

Using the above calculations, one may obtain the extreme or maximum positional uncertainty values at each survey position or selected position along an existing or planned well trajectory. To find the extreme values for an entire well survey, similar calculations may be performed for each survey position, wherein $$N\text{max} = \max(\text{Temp}N\text{max}) \quad (8)$$

$$N\text{min} = \min(\text{Temp}N\text{min}) \quad (9)$$

$$E\text{max} = \max(\text{Temp}E\text{max}) \quad (10)$$

$$E\text{min} = \min(\text{Temp}N\text{min}) \quad (11)$$

$$V\text{max} = \max(\text{Temp}V\text{max}) \quad (12)$$

$$V\text{min} = \min(\text{Temp}V\text{min}) \quad (13)$$

The slot, structure, and field bounding boxes are then constructed. The slot bounding boxes are defined by the greatest or smallest of the 6 min/max values of each well bounding box that belongs to its particular slot. This process may then be repeated for the structures using the bounding boxes of the slots. The process may then be repeated for the field(s) using the bounding boxes of the structures. Other hierarchical levels could be considered in other embodiments, and the foregoing examples of hierarchy is not intended to limit the scope of the disclosure.

After defining the geometry of the bounding boxes as explained above, well collision testing may be performed as follows, wherein A represents a well trajectory under consideration, and B represents bounding boxes evaluated hierarchically as will be further explained with reference to FIGS. 4 and 5.

$$\text{If } A\text{'s data is invalid or } B \text{ is invalid, treat as collision likely.} \quad (14)$$

$$\text{If } A \cdot N\text{max} < B \cdot N\text{min, no collision likely} \quad (15)$$

If $A \cdot N\text{min} > B \cdot N\text{max}$, no collision likely (16)

If $A \cdot E\text{max} < B \cdot E\text{min}$, no collision likely (17)

If $A \cdot E\text{min} > B \cdot E\text{max}$, no collision likely (18)

If $A \cdot V\text{max} < B \cdot V\text{min}$, no collision likely (19)

If $A \cdot V\text{min} > B \cdot V\text{max}$, no collision likely (20)

If any of the foregoing six geometric conditions fails, then collision should be considered likely and a more detailed anti-collision analysis should be performed on the subject well trajectory (A).

Figure 4:
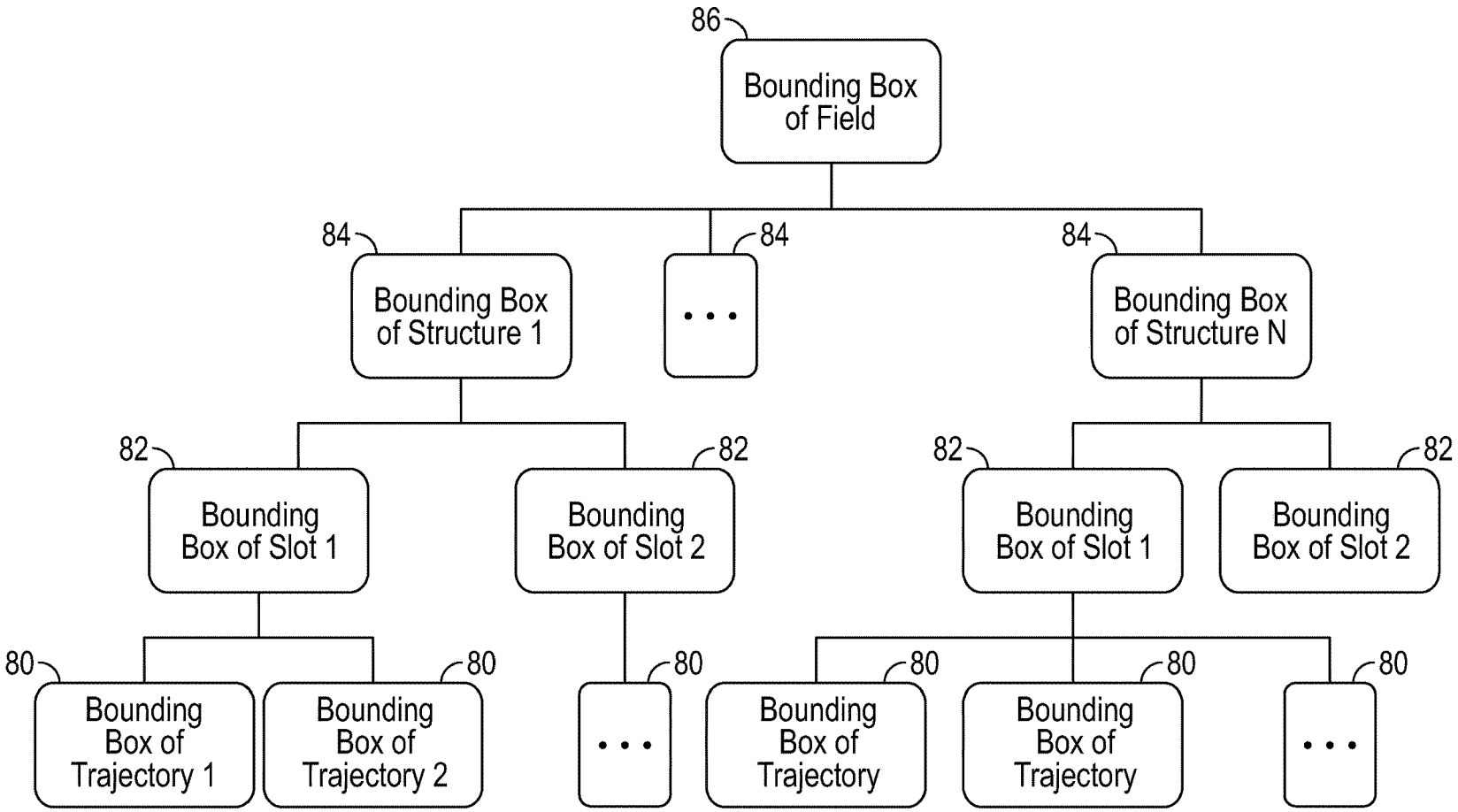
FIG. 4 shows an example hierarchy of evaluation of a planned well trajectory to screen spatial regions for those unlikely to have any well collision risk.

FIG. 4 shows an example hierarchy for evaluation according to the geometric conditions for bounding boxes described above in equations (15) through (20). At 86, an entire field may be evaluated, wherein the values of max and min for N, E and V will be for an entire field for element B to evaluate its bounding box with reference to a planned wellbore trajectory represented by A in equations (15) through (20). The drilling structure level evaluation is shown at 84. Slot level (if templates are used) is shown at 82, and individual wellbore level is shown at 80.

Figure 5:
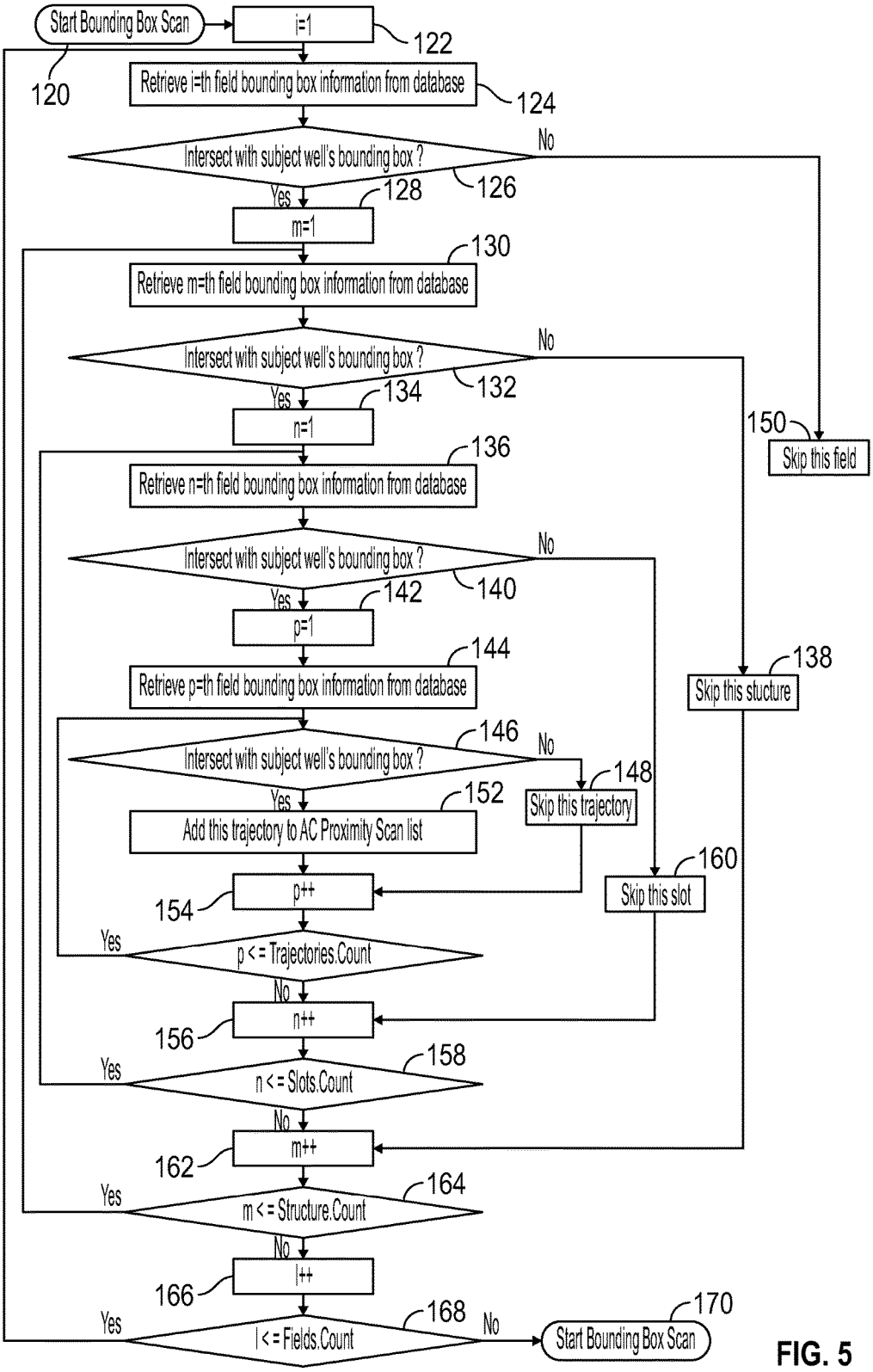
FIG. 5 shows a flow chart of an example implementation of a screening technique using bounding boxes having various structural scales.

FIG. 5 shows a flow chart of an example bounding box scan method. The scan may begin at 120 for a planned well. At 122, the bounding box of field i may be retrieved from a database, at 124. A planned well trajectory may be checked for intersection with the bounding box of the i-th field at 126. If there is no intersection of the bounding boxes, at 150, the i-th field may be removed from further evaluation and the proposed well trajectory may be considered safe with respect to the i-th field. At 166, if the i-th field is the only field under consideration, the process may end at 170. If there are additional fields for evaluation, the process may return to 124 for the i+1-th field. The foregoing process may be repeated until all relevant fields have been evaluated.

At 128, if the bounding boxes as described above have any intersection, the process may then evaluate the bounding box of structure m at 130, wherein existence of any intersection between the bounding box of the planned well and the m-th structure may be determined at 132. If there is no intersection, at 136, the process may revert to 162, where a next structure (m+1) may be evaluated. The foregoing may be repeated until all structures in a particular field are evaluated as explained above. In the event there is intersection between any structure's bounding box and the planned well trajectory bounding box, at 134, the process may retrieve from the database the bounding box for a first slot (n=1) associated with the structure m for which there is intersection between the planned well trajectory bounding box and the first slot bounding box. At 160, if there is no intersection between the planned trajectory bounding box and the first slot bounding box, the process may revert to 156 and the next slot n=n+1 may have its bounding box evaluated against the planned trajectory bounding box. The foregoing may be repeated until all slot bounding boxes have been evaluated If there is intersection between any slot's bounding box and the planned trajectory bounding box, at 142, a first existing well trajectory bounding box p=1 may be retrieved at 144 evaluated against the planned well trajectory bounding box at 146. If there is no bounding box intersection, at 148, the next existing well path in the present slot, p=p+1, at 154, may have its bounding box evaluated. The foregoing may be repeated until all existing well trajectories in the present slot have been evaluated. If the existing well trajectory bounding box intersects the bounding box of any well in the present slot, at 146, a complete anti-collision scan over the entire well trajectory of each of the existing well and the planned well trajectories may be performed, for example using the EOU technique described above. Adjustments to the planned well trajectory may be made over intervals where the possible minimum distance (considering the EOU at the relevant positions along each well trajectory) between well trajectories falls below a minimum distance between wellbores prescribed by any applicable safety standard (e.g., governmental agency, well operator policy, drilling contractor policy, etc.).

When all fields, structures, slots and well trajectories have been evaluated, the process may end at 170.

The present evaluation method may also be used during the drilling of a wellbore, using equipment as described with reference to FIG. 1 or other above-described directional drilling systems. When performed during drilling, at selected wellbore length intervals, e.g., every 30 meters, the drilling may be stopped and a directional survey may be taken at such time. A well trajectory may be calculated based on the survey being made and previous surveys. The well trajectory may be calculated using any method known in the art, for example and without limitation, radius of curvature, minimum curvature, and tangential techniques. The calculated trajectory may be used as explained above to calculate a bounding box, and the bounding box may be evaluated as explained with reference to FIG. 5 to determine if changes in the planned trajectory yet to be drilled should be made to reduce the chance of collision with an existing well.

A method for calculating likelihood of well collision according to the present disclosure may reduce the time and computational cost needed to determine whether a planned well trajectory or a while drilling well trajectory is safe by rapidly screening fields, drilling structures, and existing well trajectories for those that are unlikely to require detailed anti-collision evaluation. Additional details regarding the techniques described in this U.S. Provisional Patent Application may be further understood with reference to the attached Appendix A (incorporated herein by reference and also attached hereto) entitled "*Well Trajectory Planning Using Bounding Box Scan for Anti-Collision Analysis.*"

While only certain embodiments have been described in the present disclosure, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for evaluating a planned well trajectory for avoidance of collision with an existing wellbore, comprising:

using a processor, constructing a bounding box about the planned well trajectory and a bounding box for a trajectory of an existing wellbore, the trajectory for the existing well being constructed from survey data obtained from the existing well;

determining, using the processor, whether there is an intersection between the bounding boxes, wherein determining comprises:

determining that the bounding box of the planned well trajectory intersects a bounding box of a selected geographic area; and in response to determining that the bounding box of the planned trajectory intersects the bounding box of the selected geographic area:

selecting a subset of a plurality of well trajectories associated with the selected geographic area, wherein the trajectory for the existing well and one or more other well trajectories are part of the subset;

obtaining a boundary box encompassing the subset;

determining that the bounding box for the planned well trajectory intersects the bounding box encompassing the subset; and in response to determining that the bounding box for the planned well trajectory intersects the bounding box encompassing the subset, determining whether the bounding box for the planned well trajectory intersects the bounding box of the trajectory; and using the planned well trajectory for drilling a well if no intersection exists, and taking a corrective action otherwise.

2. The method of claim 1 wherein each bounding box comprises an aligned axis bounding box.

3. The method of claim 1 wherein each bounding box is constructed by adding and subtracting along each of three dimensions of a spatial position of each well trajectory at selected positions therealong of a maximum of eigenvalues of a covariance matrix of uncertainty of each spatial position.

4. The method of claim 1 wherein the planned well trajectory is used unchanged to drill a wellbore if there is no intersection between the bounding box for the selected geographic area and the bounding box for the planned well trajectory.

5. The method of claim 1 wherein selecting the subset of the plurality of wells in the geographic area comprises:

generating bounding boxes associated with respective drilling structures of a plurality of drilling structures associated with the selected geographical area; and determining whether there is an intersection between any of the bounding boxes associated with the respective drilling structures and the bounding box of the planned well trajectory.

6. The method of claim 5 wherein the planned well trajectory and any of the drilling structure bounding boxes, a bounding box is generated for each existing well path associated with the drilling structure having the intersecting bounding box.

7. The method of claim 6 wherein each existing well path bounding box is evaluated for intersection with the planned well trajectory bounding box, and if no intersections exist between any of the existing well bounding boxes and the planned trajectory bounding box, a wellbore is drilled along the planned trajectory.

8. The method of claim 6 wherein if an intersection exists between any existing well path bounding box and the planned trajectory bounding box, an anti-collision scan is performed along well lengths wherein the intersection exists.

9. The method of claim 8 wherein the planned well trajectory is adjusted if the anti collision scan determines a possible distance between the planned well trajectory and the existing well path falls below a predetermined value.

10. A method for directionally drilling a well, comprising:

operating a directional drilling system to cause a well to follow a planned well trajectory;

at selected length intervals during operating the directional drilling system, stopping drilling and obtaining a directional survey at a point of the stopping;

determining a well trajectory from the directional survey and any prior directional surveys;

constructing a bounding box about the determined well trajectory and a bounding box for a trajectory of an existing wellbore;

determining that the bounding box of the determined well trajectory intersects a bounding box of a selected geographic area;

in response to determining that the bounding box of the determined trajectory intersects the bounding box of the selected geographic area:

selecting a subset of a plurality of well trajectories associated with the selected geographic area, wherein the trajectory for the existing well and one or more other well trajectories are part of the subset;

obtaining a boundary box encompassing the subset;

determining that the bounding box for the determined well trajectory intersects the bounding box encompassing the subset; and in response to determining that the bounding box for the determined well trajectory intersects the bounding box encompassing the subset, determining whether the bounding box for the planned well trajectory intersects the bounding box of the trajectory; and if there is no intersection between the bounding boxes of the determined well trajectory and the planned well trajectory, continuing drilling the well along the planned well trajectory.

11. The method of claim 1, wherein selecting the subset comprises selecting a structure from among a plurality of structures associated with the selected geographical area, and wherein the bounding box encompassing the subset encompasses the structure and does not encompass at least a portion of the others of the plurality of structures.

12. The method of claim 1, wherein selecting the subset comprises selecting a slot from among a plurality of slots associated with a structure of a plurality of structures associated with the selected geographic area, and wherein the bounding box encompasses the slot and does not encompass at least a portion of the others of the plurality of slots.

13. The method of claim 1, wherein selecting the subset comprises:

determining that the bounding box for the planned well trajectory intersects a bounding box for a structure associated with the selected geographic area; and determining that the bounding box for the planned well trajectory intersects a bounding box for a slot associated with the structure, wherein the existing well is associated with the slot.

14. The method of claim 10 wherein the planned well trajectory is used unchanged to drill a wellbore if there is no intersection between the geographic area bounding box and the planned well trajectory bounding box.

15. The method of claim 10 wherein each bounding box comprises an aligned axis bounding box.

16. The method of claim 10 wherein each bounding box is constructed by adding and subtracting along each of three dimensions of a spatial position of each well trajectory at selected positions therealong of a maximum of eigenvalues of a covariance matrix of uncertainty of each spatial position.

17. The method of claim 10 wherein selecting the subset of the plurality of wells in the geographic area comprises:

generating bounding boxes associated with respective drilling structures of a plurality of drilling structures associated with the geographic area; and determining whether there is an intersection between any of the bounding boxes associated with the respective drilling structures and the bounding box of the planned well trajectory.

18. The method of claim 17 wherein if an intersection exists between the planned well trajectory and any of the drilling structure bounding boxes, a bounding box is generated for each existing well path associated with the drilling structure having the intersecting bounding box.

19. The method of claim 18 wherein each existing well path bounding box is evaluated for intersection with the planned well trajectory bounding box, and if no intersections exist between any of the existing well bounding boxes and the planned trajectory bounding box, a wellbore is drilled along the planned trajectory.

20. The method of claim 19 wherein if an intersection exists between any existing well path bounding box and the planned trajectory bounding box, an anti-collision scan is performed along well lengths wherein the intersection exists.

21. The method of claim 20 wherein the planned well trajectory is adjusted if the anti collision scan determines a possible distance between the planned well trajectory and the existing well path falls below a predetermined value.

* * * * *